US012703960B2

(12) United States Patent
Gentle et al.

(10) Patent No.: US 12,703,960 B2
(45) Date of Patent: Aug. 11, 2026

(54) SYSTEM AND METHOD OF MONITORING AND ADJUSTING BLADE PITCH TO INHIBIT BLADE DAMAGE

(71) Applicant: Caterpillar Inc., Peoria, IL (US)

(72) Inventors: Michael C. Gentle, Maroa, IL (US); Ethan M. Tevis, Bloomington, IL (US); Nathaniel K. Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 461 days.

(21) Appl. No.: 18/505,808

(22) Filed: Nov. 9, 2023

(65) Prior Publication Data

US 2025/0154743 A1 May 15, 2025

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/847* (2013.01); *E02F 3/7645* (2013.01); *E02F 9/265* (2013.01)

(58) Field of Classification Search

CPC . E02F 3/764; E02F 3/844; E02F 3/847; E02F 9/265

See application file for complete search history.

(56) References Cited

U.S. PATENT DOCUMENTS

| | | | | |
|---|---|---|---|---|
| 6,470,606 | B1 * | 10/2002 | Nagahiro | E02F 9/26 37/348 |
| 9,243,381 | B2 * | 1/2016 | Behmlander | E02F 3/8152 |
| 9,279,235 | B1 * | 3/2016 | Becicka | G01S 19/14 |
| 9,551,130 | B2 * | 1/2017 | Hendron | E02F 3/7631 |
| 9,593,461 | B2 * | 3/2017 | Faivre | E02F 9/2221 |
| 9,637,889 | B2 * | 5/2017 | Elkins | E02F 3/764 |
| 9,945,096 | B2 * | 4/2018 | Cherney | E02F 3/7618 |
| 2004/0010359 | A1 * | 1/2004 | Koch | E02F 9/265 701/50 |
| 2009/0313860 | A1 * | 12/2009 | Breiner | E02F 3/845 37/301 |
| 2011/0046857 | A1 * | 2/2011 | Farmer | E02F 3/845 701/50 |
| 2011/0213529 | A1 * | 9/2011 | Krause | E02F 3/431 701/50 |
| 2016/0138248 | A1 * | 5/2016 | Conway | E02F 9/261 701/34.2 |
| 2016/0208460 | A1 * | 7/2016 | Kirsch | E02F 3/764 |
| 2017/0037583 | A1 * | 2/2017 | Gillespie | E01C 23/082 |
| 2017/0103506 | A1 * | 4/2017 | Dandibhotla | G06F 18/2411 |
| 2018/0066415 | A1 * | 3/2018 | Friend | E02F 9/262 |
| 2018/0216315 | A1 * | 8/2018 | Benson | E02F 3/844 |
| 2020/0173135 | A1 * | 6/2020 | Gentle | E02F 3/7627 |

(Continued)

*Primary Examiner* — Christopher J Sebesta
*Assistant Examiner* — Audrey L Lusk

(57) ABSTRACT

System and method for inhibiting damage to a moldboard of a mobile work machine including a blade pitch sensor, a camera configured to detect the blade cutting edge, and a controller configured to determine a maximum allowable pitch of the blade based upon current width of the cutting edge determined from a camera signal. The controller determines if the current measured pitch is greater than the maximum allowable pitch of the blade based upon characteristics of the mobile work machine and the current width of the cutting edge to prevent damage to the moldboard.

20 Claims, 6 Drawing Sheets

(56) References Cited

U.S. PATENT DOCUMENTS

| | | | | |
|---|---|---|---|---|
| 2020/0173138 | A1* | 6/2020 | Gentle | E02F 3/844 |
| 2020/0362535 | A1* | 11/2020 | Veasy | E02F 3/765 |
| 2020/0362542 | A1* | 11/2020 | Veasy | E02F 3/765 |
| 2021/0372083 | A1* | 12/2021 | Velde | E02F 9/205 |
| 2022/0316188 | A1* | 10/2022 | Takahama | E02F 3/841 |

* cited by examiner

SYSTEM AND METHOD OF MONITORING AND ADJUSTING BLADE PITCH TO INHIBIT BLADE DAMAGE

TECHNICAL FIELD

This patent disclosure relates generally to monitoring of tooling associated with a machine used in grading operations and, more particularly to an arrangement and a method for monitoring a wear on a blade used in such a machine.

BACKGROUND

Motor graders are often used for construction, road-building, rural road resurfacing, shallow ditching, field preparation, snow removal, and other industrial activities requiring the preparation of a flat earthen or particulate surface. A motor grader typically includes a ground engaging element such as a plurality of wheels that convey the machine over the ground, and a blade assembly extending from the underside of the machine and disposed generally transverse to both the underlying surface and the direction of travel. The blade of the blade assembly can generally be manipulated in a plurality of directions and dimensions by the machine operator. Some motor graders may be equipped with a wing that may be disposed to the side of the motor grader. Such wings may be disposed on either or both sides of the motor grader, and similarly include a blade assembly having a blade.

A motor grader blade may include a blade having a cutting edge or a moldboard to which one or more tips or cutting edges are secured. The cutting edges are important for maintaining proper road profile in the case of a blade assembly on the underside of the machine, or providing desired snow and ice removal in the case of a wing. Thus, operators are required to check blade condition frequently. Neglecting to replace cutting edges of a blade may reduce machine productivity, and may increase road maintenance cost. Moreover, if ignored for a long period, excess wear may result in damage to the moldboard which requires significantly greater machine downtime and cost to repair than normal maintenance, such as replacing the blade cutting edge when significant wear is observed.

U.S. Pat. No. 9,945,096 to Cherney discloses a system and method for automatically adjusting blade pitch in crawler dozers, motor graders, and other bladed work vehicles. The arrangement estimates a current tractive force of the work vehicle utilizing one or more controllers that establish whether the current tractive force of the work vehicle can be reduced by rotating the blade to an optimized pitch angle.

SUMMARY

According to an aspect of this disclosure, there is provided mobile work machine having given machine parameters. The machine includes a frame, a plurality of wheels supporting the frame, one or more of the plurality of wheels being driven, and a blade extending from the frame toward a surface underlying the mobile work machine. The blade includes a cutting edge disposed along a lower edge of the blade. The machine further includes one or more blade tilt cylinders configured to articulate the blade to a plurality of pitch angles, a blade pitch sensor configured to detect a current pitch of the blade, a camera, the camera configured to detect the cutting edge, and a control system to control damage to the blade. The control system includes at least one controller configured to receive image data, determine a current width of the cutting edge based on the image data, and determine a maximum allowable pitch angle of the blade based on one or more machine parameters of the motor grader and based on the current width of the cutting edge, wherein exceeding the maximum allowable pitch angle is associated with a damage condition of the blade.

According to another aspect of this disclosure, there is provided a system for controlling damage to a blade of a motor grader, the blade including a cutting edge disposed along a lower edge of the blade. The motor grader further includes one or more blade tilt cylinders configured to articulate the blade to a plurality of pitch angles. The system includes a blade pitch sensor configured to detect a current pitch of the blade, a camera that is configured to detect the cutting edge, and a control system including a controller. The controller is configured to receive image data associated with the camera, determine a current width of the cutting edge based on the image data, and determine a maximum allowable pitch angle of the blade based on one or more machine parameters of the motor grader and based on the current width of the cutting edge, wherein exceeding the maximum allowable pitch angle is associated with a damage condition of the blade.

According to yet another aspect of this disclosure, there is provided a method of controlling damage to a blade of a motor grader. The blade includes a cutting edge that is disposed along a lower edge of the blade. The motor grader further includes one or more blade tilt cylinders configured to articulate the blade to a plurality of pitch angles. The method includes determining a current width of the cutting edge based on image data associated with a camera of the motor grader that is configured to detect the cutting edge, determining a maximum allowable pitch angle of the blade based on one or more machine parameters of the motor grader and based on the current width of the cutting edge, wherein exceeding the maximum allowable pitch angle is associated with a damage condition of the blade, determining a current pitch angle of the blade, determining if the current pitch angle exceeds the maximum allowable pitch angle; and if the current pitch angle exceeds the maximum allowable pitch angle, at least one of causing an action to be performed or indicating that an action is to be performed, in relation to the current pitch angle, to avoid the damage condition.

DETAILED DESCRIPTION

In general, this disclosure relates to mobile work machines, and, more particularly, to motor graders, which are machines used for grading of surfaces, i.e., smoothing an earthen or other particulate surface for construction, road building, snow removal and other application that requires the creation of a relatively smooth or flat surface. A motor grader typically includes a plurality of wheels that convey the machine over the ground, as well as one or more large blades beneath the machine for removing surface material.

Figure 1:
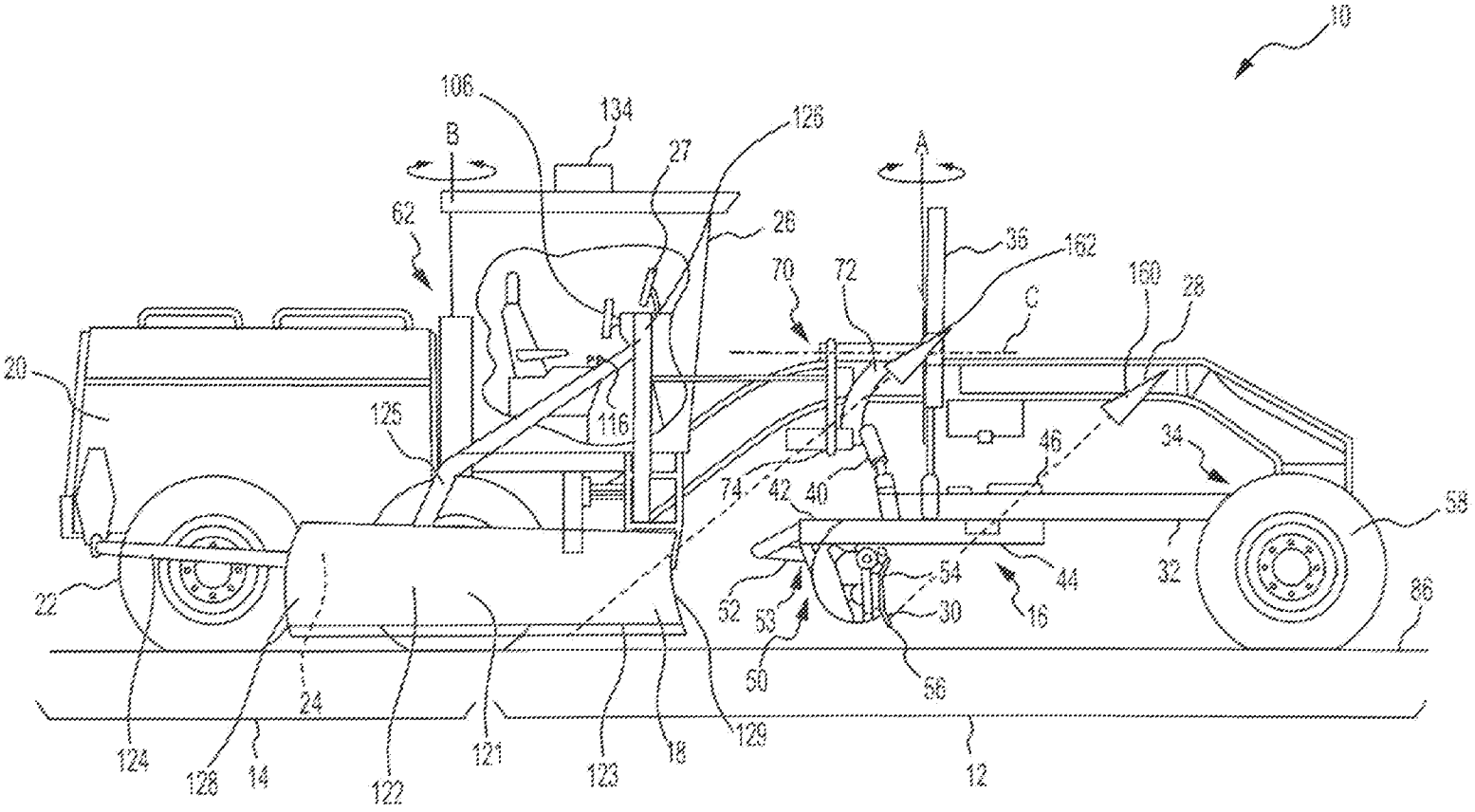
FIG. 1 is a side elevational view of an exemplary motor grader including an exemplary embodiment of a system according to aspects of this disclosure.
Figure 2:
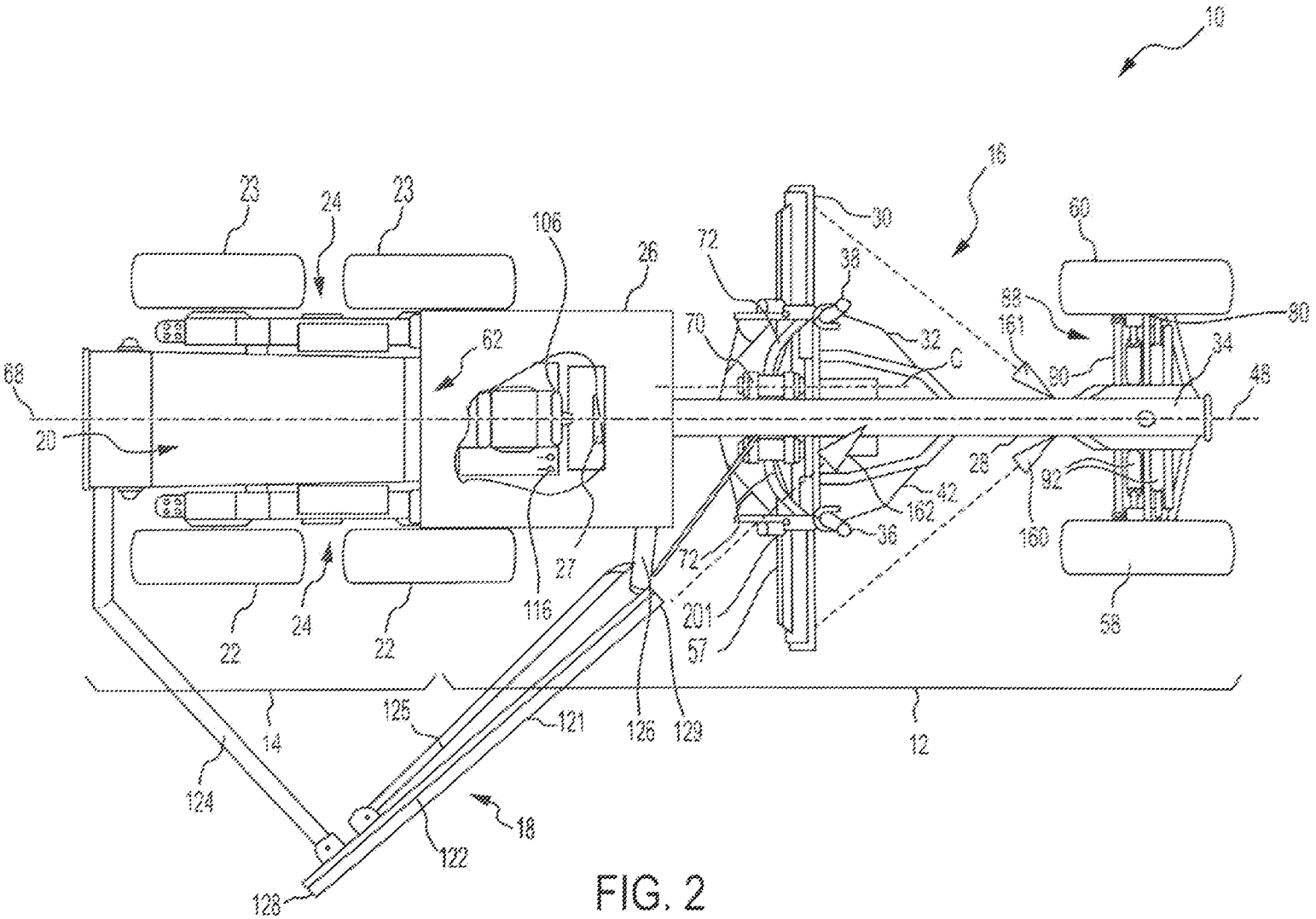
FIG. 2 is a top plan view of the motor grader of FIG. 1.

FIGS. 1-2 are schematic views of a motor grader 10 that incorporates a monitoring system and method for inhibiting damage to a blade of a motor grader. As shown, motor grader 10 includes a front frame 12, rear frame 14, and at least one work implement, such as main blade assembly 16 and/or a wing 18. Rear frame 14 includes a power source (not visible), which is typically contained within a rear compartment 20. The power source is operatively coupled through a transmission to rear traction devices (e.g., right wheel 22 and left wheel 23) for primary machine propulsion. The power source may be, for example, a diesel engine, a gasoline engine, a natural gas engine, or any other engine. The power source may also be an electric motor linked to a fuel cell, capacitive storage device, battery, or another source of power. Rear wheels 22, 23 are operatively supported on tandem axles 24, which are pivotally connected to motor grader 10 between rear wheels 22, 23 on each side of motor grader 10. The transmission may be a mechanical transmission, hydraulic transmission, or any other transmission type. The transmission may be operable to produce multiple output speed ratios (or a continuously variable speed ratio) between the power source and driven traction devices.

Motor grader 10 also includes an articulation joint 62 that pivotally connects front frame 12 and rear frame 14, allowing the front frame 12 to pivot relative to rear frame 14 about an articulation axis B. Motor grader steering is generally accomplished through a combination of both front wheel steering and machine articulation. As shown in FIG. 2, steerable traction devices, such as right and left front wheels 58, 60, are associated with a beam 28 of front frame 12. Front wheels 58, 60 may be both rotatable and tiltable for use during steering and leveling of a work surface 86. Front wheels 58, 60 are connected via a steering apparatus 88 that may include a linkage 90 and a hydraulic cylinder for rotation about front wheel pivot points 80 (e.g., as shown in FIG. 2), and tilt cylinders 92 to control front wheel tilt. The steerable front wheels 58, 60 and/or rear wheels 22, 23 may include tracks, belts, or other traction devices as an alternative to wheels. Front wheels 58, 60 may also be driven, as is the case in motor graders provided with all-wheel drive. For example, the power source may be operatively connected to a hydraulic pump fluidly coupled to one or more hydraulic motors associated with front wheels 58, 60. For the purposes of this disclosure, the terms "wheel" and "wheels" will be utilized to mean "traction device" or "traction devices," respectively, and will include wheels, tracks, belts, or other traction devices.

The front frame 12 supports an operator station 26 that contains operator controls, along with a variety of displays and/or indicators, such as a user interface 27, for conveying information to the operator for primary operation of motor grader 10 or for receiving input from the operator. Operator station 26 may also include one or more steering controls 106 (e.g., for steering front wheels 58, 60 via steering apparatus 88). For example, steering controls 106 may be, or include, a steering wheel 106 or any other type of operator input device, such as a dial, joystick, keyboard, pedal, or other devices. Operator station 26 also includes one or more articulation controls 116 (e.g., for controlling right and left articulation actuators). Articulation controls 116 may be, or include, any type of operator input device, such as a dial, joystick, keyboard, pedal, or other device.

Motor grader 10 may work in conjunction with a global navigation satellite system, or GNSS. A GNSS is a satellite navigation system with global coverage that can be used to provide autonomous geo-positioning of objects associated with the GNSS, such as an autonomously operated motor grader. One example of a GNSS is a global positioning system, or GPS. The GNSS may include a satellite positioning unit 134 disposed on motor grader 10. Satellite positioning unit 134 generates signals indicative of a location of motor grader 10. Satellite positioning unit 134 may determine and generate signals corresponding to the latitude and/or longitude of motor grader 10. Satellite positioning unit 134 may be disposed on a top portion of motor grader 10 (e.g., on operator station 26, as shown in FIG. 1), to communicate with a number of satellites of the GNSS and to receive signals indicative of a location of motor grader 10, although satellite positioning unit 134 may be disposed elsewhere on motor grader 10.

The front frame 12 includes a longitudinally extending beam 28, which may support one or more work implements, such as the main blade assembly 16 that includes a blade 30. The beam 28 is employed to move the blade 30 to a wide range of positions relative to motor grader 10. Main blade assembly 16 is one example of a work implement that can bear a load on motor grader 10. Other work implements can include a front blade assembly, rippers, scarifiers, and wings (discussed further below).

Main blade assembly 16 includes a drawbar 32 pivotally mounted to a first end 34 of beam 28 via a ball joint or the like. The position of drawbar 32 is typically controlled by hydraulic cylinders including a right lift cylinder 36 and left lift cylinder 38 (FIG. 2) that control vertical movement, and a drawbar sideshift or centershift cylinder 40 (FIG. 1) that controls horizontal movement. Inasmuch as the centershift cylinder 40 controls shifting of the circle 44, the centershift cylinder 40 is sometimes referred to as a circle centershift cylinder or a circle sideshift cylinder. Right and left lift cylinders 36, 38 are connected to a coupling 70 that includes lift arms 72 pivotally connected to beam 28 for rotation about respective yoke axes C. For example, yoke axis C is noted in FIG. 2 with regard to the left lift cylinder 38. The right lift cylinder 36 rotates about a similarly situated axis on the opposite side of the beam 28 from that illustrated in FIG. 2. A bottom portion of coupling 70 may have an adjustable length horizontal member 74 that is connected to centershift cylinder 40.

Drawbar 32 may include a large, flat plate, commonly referred to as a yoke plate 42. Beneath yoke plate 42 is a circular gear arrangement and mount, commonly referred to as a circle 44. Circle 44 is rotated by, for example, a hydraulic motor referred to as a circle drive 46. Rotation of circle 44 by circle drive 46 rotates an attached blade 30 about an axis A perpendicular to a plane of drawbar yoke plate 42.

The blade 30 is mounted to a sliding joint associated with circle 44 that allows the blade 30 to slide or shift from side-to-side relative to circle 44. The side-to-side shift is commonly referred to as blade sideshift. One or more sideshift cylinders 57 or the like are used to control the blade sideshift.

Figure 3:
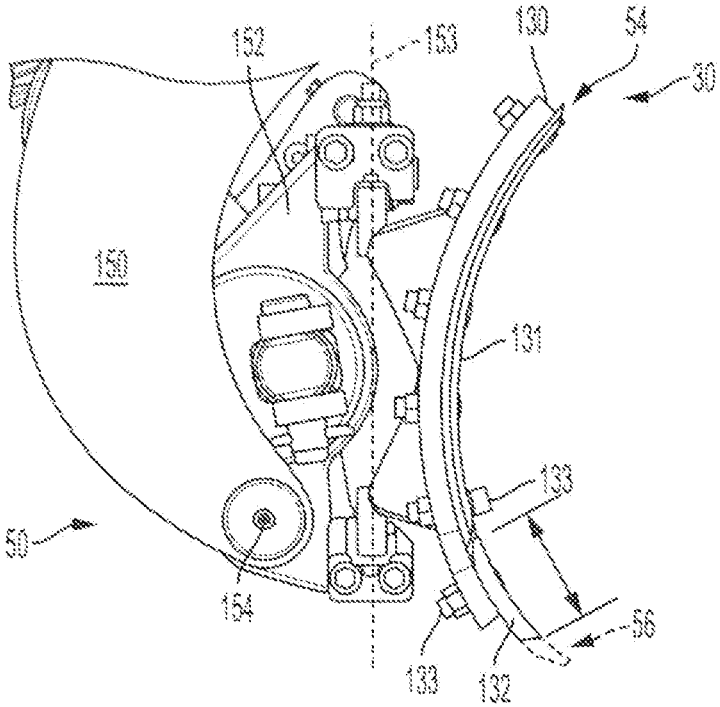
FIG. 3 is an enlarged fragmentary side elevational view of an exemplary blade assembly of the motor grader of FIGS. 1 and 2.

The blade 30 is also mounted to circle 44 via a pivot assembly 50 that allows for tilting of blade 30 relative to circle 44. A tip cylinder 52 is used to tilt the blade 30 forward or rearward. In other words, tip cylinder 52 is used to tip or pitch a top edge 54 of blade 30 relative to a bottom cutting edge 56 of blade 30, which is commonly referred to as a blade tip or blade pitch. An appropriate blade pitch sensor 53 may be disposed at any appropriate location to provide a current measurement of the blade pitch, Referring to FIG. 3, the illustrated pivot assembly 50 supporting the blade 30 includes a first support structure 150 to which a second support structure 152 is pivotably coupled at pivot joint 154. The blade 30 is secured with the second support structure 152. The tip cylinder 52 is disposed to pivot the second support structure 152 about the pivot joint 154 such that top edge 54 of the blade 30 is tilted forward or rearward relative to the bottom cutting edge 56. Referring to FIG. 3, the top edge 54 is tilted forward relative to the bottom cutting edge 56, while, in FIG. 4, the top edge 54 is tilted rearward relative to the bottom cutting edge 56.

Figure 4:
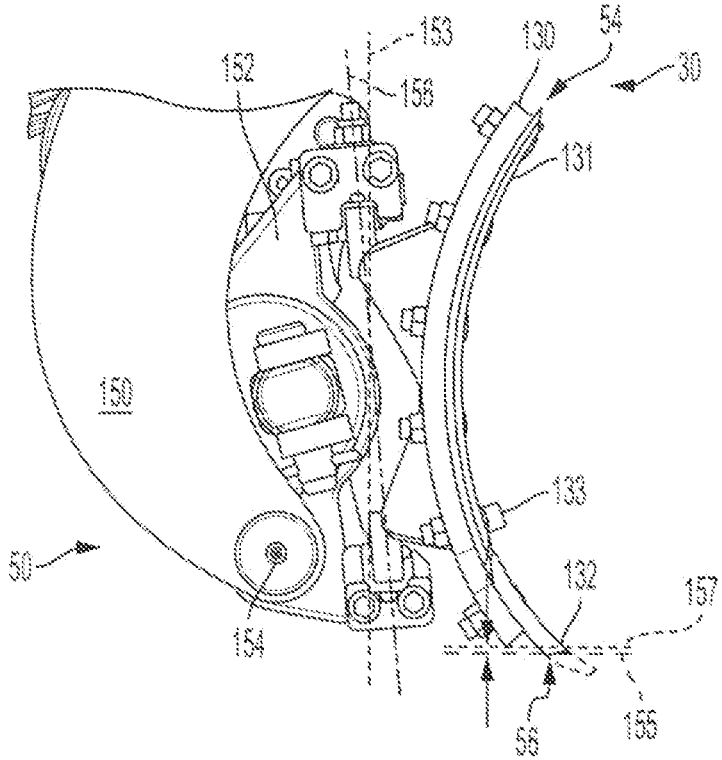
FIG. 4 is an enlarged fragmentary side elevational view of the exemplary blade assembly of FIG. 3, illustrating the blade at an alternative pitch.

The blade 30 may be a unitary structure or an assembly presenting the bottom cutting edge 56. In FIGS. 3 and 4, the blade 30 includes a moldboard 130 to which a first blade structure 131 and a replaceable cutting edge 132 are attached by a cutting edge retention system, such as a plurality of fasteners 133, for example bolts or other attachment device(s). In this embodiment, the replaceable cutting edge 132 presents the bottom cutting edge 56.

Returning to FIGS. 1 and 2, the motor grader 10 may include a snow wing or wing assembly 18 that also presents a wing blade 121. As with the blade 30, the wing blade 121 may be a unitary structure or an assembly that may include a moldboard 122, to which a replaceable cutting edge 123 is attached at a lower edge by a cutting edge retention system, such as a plurality of fasteners (e.g., bolts).

The wing assembly 18 may include one or more wing actuators. The wing actuator(s) can be configured to operate independently or in concert with each other to change an orientation of the wing blade 121 relative to the motor grader 10. For example, the wing assembly 18 can include at least one of the following: (i) a wing brace or support actuator 124, (ii) a wing tilt actuator 125, and/or (iii) a wing mast actuator 126. The wing support actuator 124 can be coupled (e.g., operably, etc.) to the rear frame 14, and can be configured to rotate, pivot, or otherwise change the orientation of the wing blade 121 relative to the motor grader 10. In some embodiments, this can include changing an angle of the wing blade 121 (e.g., the wing axis) relative to the rear frame 14 and/or moving a first end portion 128 of the wing blade 121 in the vertical direction (e.g., to raise and/or lower the first end portion 128).

The wing mast actuator 126 can be coupled (e.g., operably, etc.) to the front frame 12, and can be configured to rotate, pivot, or otherwise change the orientation of the wing blade 121 relative to the motor grader 10 to move the second end portion 129 in the vertical direction (e.g., to raise and/or lower the second end portion 129). The wing tilt actuator 125 can be coupled (e.g., operably, etc.) to the wing mast 126, and can be configured to move the first end portion 128 of the wing blade 121 in the vertical direction (e.g., to raise and/or lower the first end portion 128). The wing tilt actuator 125 and the wing support actuator 126 can operate independently or in combination to move the first end portion 128 of the wing blade 121 in the vertical direction.

Each of the wing actuators can include one or more motors, solenoids, pistons, hydraulics, gears, joints, a combination thereof, and/or any other suitable actuator. In at least some embodiments, the wing assembly 18 can adjust the wing blade 121 to an orientation and/or a position of the wing blade 121 to correspond with or match an orientation of the blade 30.

According to an aspect of this disclosure there is provided a monitoring system for monitoring wear of at least one cutting edge 123, 132 to inhibit damage to the associated blade 30, 121 (e.g., moldboard 122, 130 and/or the cutting-edge retention system). Such damage could occur, for example, when an operator adjusts a pitch or tilt of the blade 30, 121 rearwards beyond a predetermined threshold that would result in damaging the associated moldboard 122, 130 and/or the cutting edge retention system.

Referring to FIGS. 3 and 4, for example, the illustrated blade 30 includes a cutting edge 132 that has been partially worn, the dotted lines extending from the cutting edge 132 illustrating an unworn length of the cutting edge 132. FIG. 3 illustrates a blade 30 that is not pitched in either direction. That is, the blade 30 in FIG. 3 is vertical (see dotted line 153 illustrating the axis of the blade 30). With the current, partial wear on the cutting edge 132 and the blade 30 being vertical, the cutting edge 132 still extends to a lower plane than the bottom edge of the moldboard 130. Accordingly, utilization of the motor grader 10 with the blade 30 and blade position as illustrated in FIG. 3 would not likely result in damage to the moldboard 130.

Referring to FIG. 4, the illustrated blade 30 has been pitched rearward (see dotted line 156 illustrating the pitched axis of the blade 30) from the vertical position. As may be seen by the generally horizontal plane 155 extending along the distal end of the cutting edge 132 toward the distal end of the moldboard 130, the cutting edge 132 extends lower than the moldboard 130. Accordingly, in this position, the utilization of the motor grader 10 with the blade 30 as illustrated would not likely result in damage to the moldboard 130, the vertical distance 158 from the distal end 157 of the moldboard 130 to the horizontal plane 155 at the distal end of the cutting edge 132 illustrating additional wear of the cutting edge 132 before damage would likely result to the moldboard 130. Pitching the blade 30 further rearward, however, could result in damage to the moldboard 130. The extent to which the distal end 157 of the moldboard 130 would preferably be spaced from the horizontal plane 155 at the distal end of the cutting edge 132 may differ based upon the terrain on which the motor grader 10 is to be operated, for example.

The disclosed system for inhibiting damage to a moldboard includes at least one camera 160, 161, 162 disposed to observe the at least cutting edge 132, 123. The camera 160, 161, 162 may be utilized to provide an initial determination of the width of the cutting edge 132, 123, or the initial width may be provided as a machine parameter. While multiple cameras 160, 161, 162 are illustrated in the embodiment of FIGS. 1 and 2, a greater or lesser number of cameras may be provided. Further, where both a blade 30 and one or more wing blades 121 are provided, one or more cameras 160, 161, 162 may be provided to observe one or more of the blades 30, 121. In the illustrated embodiment, two cameras 160, 161 are disposed to observe the cutting edge 132 of the blade 30 along either side of the beam 28. In some embodiments, a single camera may be provided to observe the cutting edge 132 of the blade 30. In some embodiments, at least one camera 162 is provided to observe the cutting edge 123 of the wing blade 121, as shown for example in FIGS.

1 and 2. In some embodiments, two or more cameras may be provided to observe the cutting edge 123 of the wing blade 121. Further, the one or more cameras 160, 161, 162 may be stationarily mounted, or may be mounted for movement (e.g., manual movement or automated movement). While this disclosure illustrates a motor grader 10, those of skill in the art will appreciate that the arrangements herein may be applied to other mobile work machines provided the at least one camera 160, 161, 162 may be disposed to provide an image of the cutting edge of the mobile work machine.

Figure 6:
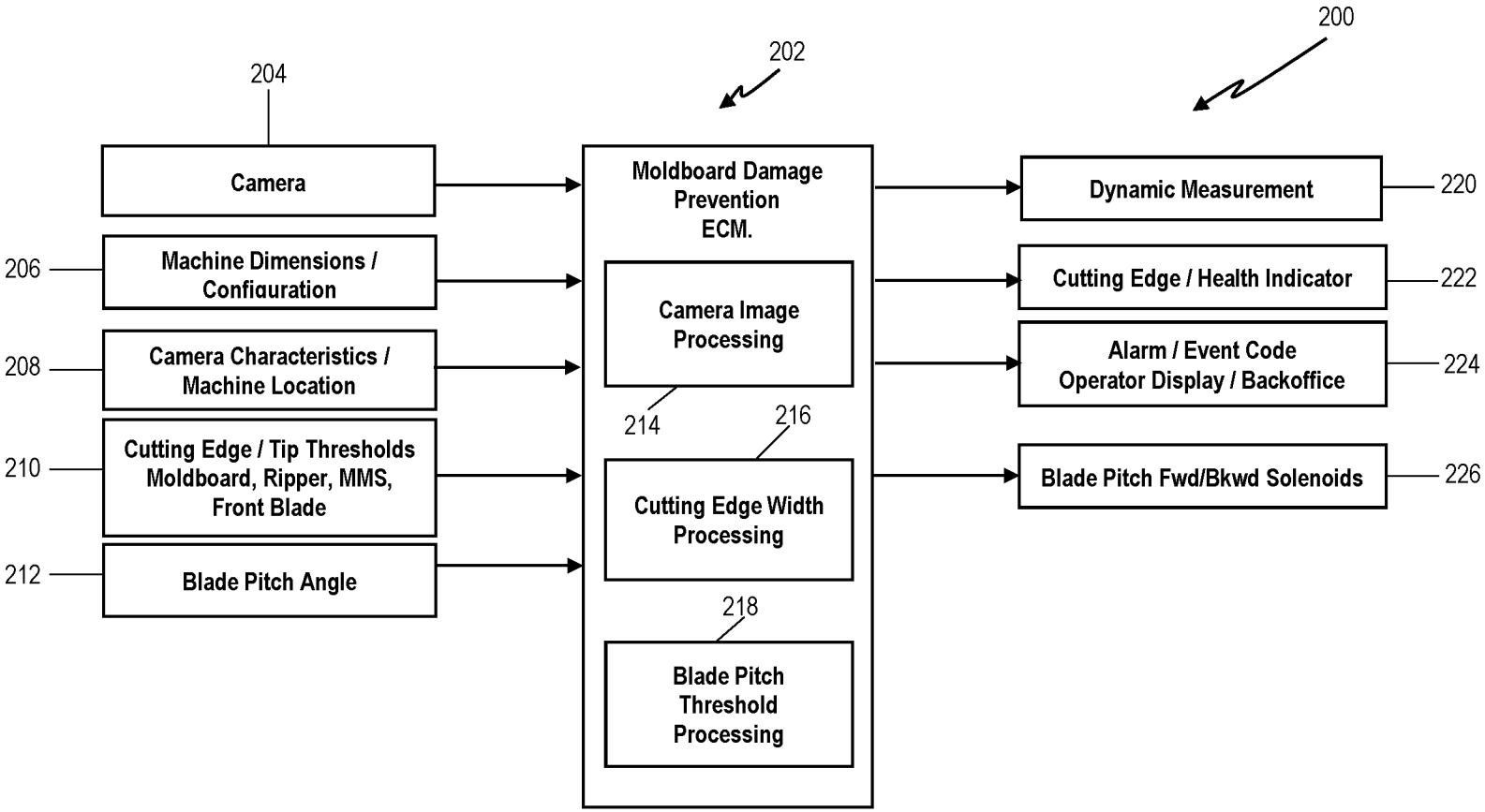
FIG. 6 is a flow chart showing exemplary inputs to a system to inhibit blade damage and resultant actions/output in accordance with the described principles of this disclosure.

The system further includes a control system (shown generally as 200 in FIG. 6) including at least one controller (e.g., electronic control module 202) configured to determine an allowable pitch of the at least one blade based upon a current width of the cutting edge. The allowable pitch is determined by the controller 202 based upon data regarding the current width of the cutting edge observed by the at least one camera, as well as information relative to the machine itself and the current operation of the machine (shown along the left hand side of FIG. 6) in order to provide one or more resultant actions (shown along the right hand side of FIG. 6).

That is, the controller 202 receives signals 204 from the at least one camera. Such signals 204 may include signals indicative of the initial width of the cutting edge 132, 123, as well as signals indicative of changes in the width of the cutting edge 132, 123, (e.g., a current width of the cutting edge 132, 123). The controller 202 additionally is provided with or receives machine information 206 (e.g., machine parameters such as machine dimensions, machine configurations, machine specifications, and other machine-related information) about the motor grader 10. The controller 202 is provided with information regarding the at least one camera (208), such as information regarding the physical location of the camera and the angle at which the camera views the cutting edge. The controller 202 is also provided with information (210) regarding the moldboard and cutting edge, and their relationship to one another, including thresholds relative to a degree of wear that may be tolerated by the cutting edge. Additionally, the controller 202 is provided with information or at least one signal regarding the current blade pitch angle 212.

The controller 202 then processes the camera image (214) of the observed cutting edge of the blade, and utilizes information such as the camera characteristics and location on the machine (208), and the current blade pitch angle (212) of the blade 30 to determine the current cutting edge width (216, 220). The controller 202 further utilizes information such as the current cutting edge width, as well as the machine parameters (206) to determine a maximum allowable or pitch threshold (218) of the blade 30. This information may then be compared to the current blade pitch angle (212) to determine if a reduction in the blade pitch is advisable in order to inhibit damage to the moldboard 130, for example.

Figure 5:
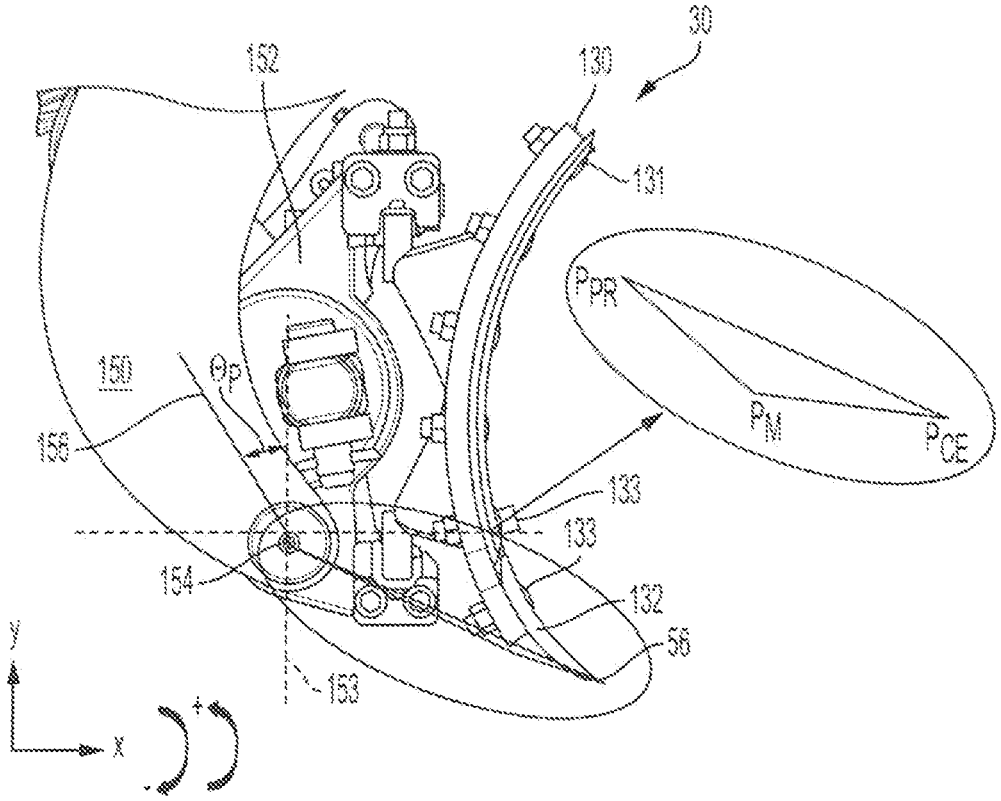
FIG. 5 is the enlarged fragmentary side elevational view of the blade assembly of FIG. 3, and illustrating bases for certain exemplary calculations of this disclosure.

Turning to FIG. 5, an exemplary arrangement for determining the length of the cutting edge 132 of blade 30 is provided. While the control system is explained with regard to one or both of the cameras 160, 161 disposed to observe the cutting edge 132 of the blade 30, the same or similar arrangement may be utilized with regard to the wing blade 121. In FIG. 5, a large positional triangle is illustrated as representative of the corresponding triangular representation providing in the circled oval area of the fragmentary illustration of the blade 30 and its supporting structure.

While any appropriate calculations may be provided to determine the pitch angle beyond which the blade 30 should not permitted to pitch rearward, the following are provided as exemplary of such calculations. As previously explained, the pivot point or origin of rotation is identified as 154; for the purposes of further calculations and notations, this blade pitch origin of rotation will be identified as $P_{PR}$ or $P_{PRx}$ and $P_{PRy}$. A theoretical blade pitch angle $\theta_P$ is identified by the rotation of the blade 30 from the vertical, dotted line 153 to a possible pitch position at 156. The lowermost location of the material of the moldboard 130 is identified as $P_M$ or $P_{Mx}$ and $P_{My}$. The lowermost location of the cutting edge 132 is identified as $P_{CE}$ or $P_{CEx}$ and $P_{CEy}$. Accordingly, the constant parameters based upon machine/blade geometry are the blade pitch origin of rotation $P_{PRx}$ and $P_{PRy}$, and for a given pitch angle $\theta_P$, lowermost location of the material of the moldboard 130 $P_{Mx}$, $P_{My}$. The measured variables for the current lowermost location of the cutting edge 132 are derived based upon one or more measurements from one or more cameras 161, 162 will be measured variables. That is a current position of the cutting edge 132 identified as $P_{CEx}$, $P_{CEy}$ will be a measured variable.

Rotating a point ($P_x$, $P_y$) such as the cutting edge 132, about 154, that is an origin $O_x$, may be represented by the following equations:

$$P'_x = (P_x - P_x)\cos\theta - (P_y - O_y)\sin\theta + O_x$$

$$P'_y = (P_x - P_x)\sin\theta + (P_y - O_y)\cos\theta + O_y$$

Accordingly, in order to determine the blade pitch angle $\theta_P$ beyond which the blade 30 should not be permitted to pitch rearward, one may solve for the blade pitch angle $\theta_P$ in the following equations:

$$P'_{My} = P'_{CEy}$$

$$P'_{My} = (P_{Mx} - P_{PRx})\sin\theta_P + (P_{My} - P_{PRy})\cos\theta_P + P_{PRy}$$

$$P'_{CEy} = (P_{CEx} - P_{PRx})\sin\theta_P + (P_{CEy} - P_{PRy})\cos\theta_P + P_{Pry}$$

$$\Theta_P = \tan^{-1}\left(\frac{P_{CE_y} - P_{M_y}}{P_{M_x} - P_{CE_x}}\right)$$

Thus, the information received 204, 206, 208, 210, 212 is processed by the controller 202 in order to provide one or more resultant actions. The width of current cutting edge as calculated based upon the observations of the camera 161, 162 is provided a dynamic measurement 220 of the current cutting edge 132. Comparing this dynamic measurement 220 to an initial measurement of the cutting edge 132, one can provide an indication of the health (222) and possible life expectancy of the cutting edge 132. In at least one embodiment, the system 200 may provide an alarm or event code (224) to an operator station 26 or to a remote office in the case of a motor grader 10 operated by means of a global navigation satellite system, or GNSS. In at least one embodiment, the system 200 may inhibit or prevent the execution of an operator instruction to pitch the blade 30 beyond the determined maximum allowable pitch angle $\theta_P$. In at least one embodiment, the system 200 may perform an operation to adjust the current pitch angle (212) to an angle that is not greater than the maximum allowable pitch angle $\theta_P$ (226), for example, if the current pitch angle is substantially equal to or greater than the maximum allowable pitch angle $\theta_P$. In at least one embodiment, if the operator does not adjust the current blade pitch to an acceptable angle, the monitoring system automatically adjusts the blade pitch to an angle that would inhibit moldboard damage.

INDUSTRIAL APPLICABILITY

Figure 7:
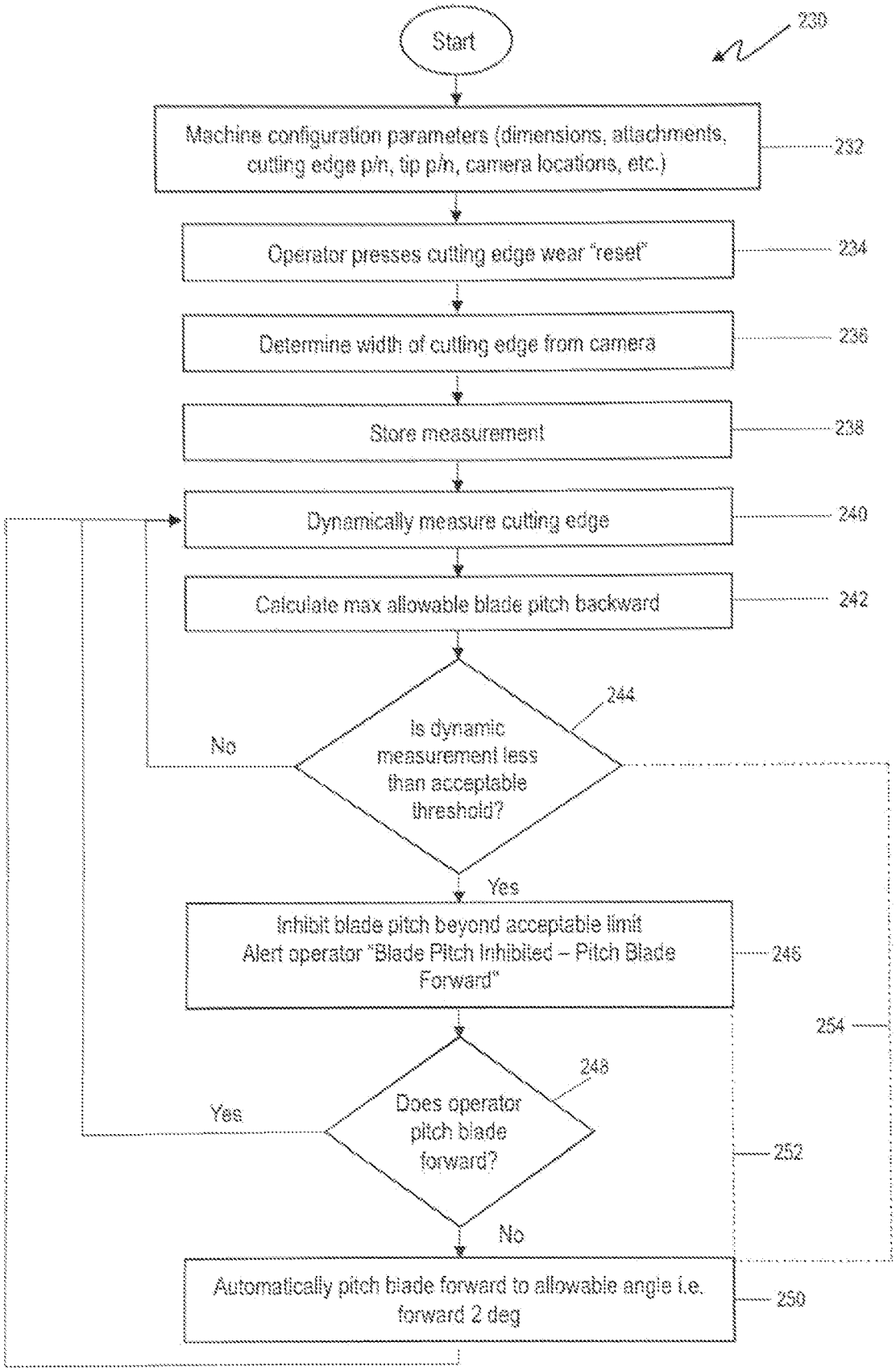
FIG. 7 is flow chart illustrating an exemplary process flow for a system to inhibit blade damage in accordance with the described principles of this disclosure.

Turning now to FIG. 7, there is illustrated an exemplary process flow 230 for a system 200 to inhibit blade damage in accordance with the described principles of this disclosure. The controller 202 is provided with basic information 232 regarding the machine, such as a motor grader 10. Such information may include, for example, dimensions, attachments to the machine, a cutting edge part number, tip part number, camera locations, etc.

In at least one embodiment, an operator may initiate the operation of the system 200 by pressing a cutting edge "reset" 234. Based on this signal, the initial width of the at least one cutting edge 132, 123 of the at least one blade 30, 121 may be determined based upon observations by the at least one camera 160, 161, 162, i.e., images observed by the camera 160, 161, 162 (236). This reference determination of the initial width of the at least one cutting edge 132, 123 is then stored (238). In at least one embodiment, information regarding the initial width of the at least one cutting edge 132, 123 may be provided as part of the basic information regarding the cutting edge (232). Accordingly, the operator initiation of the "reset" (234) and subsequent initial determination of the width of the cutting edge 132, 123 (236) and storage of the determined width (238) may not be required. In yet another embodiment, the determination of the initial width of the cutting edge 132, 123 may be initiated automatically when the machine is initial started. In yet another embodiment, this initial measurement or storage of an initial width of the cutting edge 132, 123 may not be included in the process.

During operation of the motor grader 10, the at least one camera 160, 161, 162 observes the at least one cutting edge 132, 123 to provide signals from which the dynamically measured, current width of the cutting edge 132, 123 is determined (240), and the maximum allowable blade pitch rearward $\theta_P$ is calculated (242). The current measured blade pitch, as measured by a sensor 53 or other appropriate means is compared to the maximum allowable pitch or acceptable threshold (244). If the current blade pitch is less than the maximum allowable pitch or acceptable threshold, the processes of dynamically measuring the cutting edge 132, 123 at 240 and the calculation of the maximum allowable pitch at 242 are repeated, and further comparison made of the current pitch to the maximum allowable pitch at 244. In at least one embodiment, this repetition may occur at regular intervals.

Conversely, if the current blade pitch is greater than the maximum allowable pitch or acceptable threshold (244), the system may provide appropriate signals to inhibit pitching the blade 30, 121 beyond the maximum allowable pitch (246). In at least one embodiment, an operator alert, such as "Blade Pitch Inhibited—Pitch Blade Forward," for example, may be provided (246).

In at least one embodiment, the system 200 may automatically initiate a corrective blade pitch if the operator does not pitch the blade 30, 121 forward (248). That is, if the operator does pitch the blade 30, 121 forward (248), the processes of dynamically measuring the cutting edge 132, 123 at 240 and the calculation of the maximum allowable pitch at 242 are repeated, and further comparison made of the current pitch to the maximum allowable pitch at 244. As indicated above, in at least one embodiment, this repetition may occur at regular intervals.

Referring again to 248, if the operator does not pitch the blade 30, 121 forward, then, in at least one embodiment, the system 200 will automatically pitch the blade 30, 121 forward to an allowable angle that is less than the maximum allowable pitch (250). By way of example only, the degree to which the adjusted blade pitch differs from the current blade pitch may be, for example, 2 degrees or another appropriate amount.

In at least one embodiment, the blade 30, 121 is automatically pitched forward without the further input of the operator at 248 (see dotted line 252). That is, if the dynamic, measured blade pitch is greater than the maximum allowable blade pitch, an operator alert it provide, and the blade 30, 121 is automatically pitched forward to reduce the measured blade pitch to less than the maximum allowable blade pitch (see dotted line 252). In yet another embodiment, no such alert is provided to the operator, and the blade 30, 121 is automatically pitched forward to reduce the measured blade pitch to less than the maximum allowable blade pitch (see dotted line 254).

Those of skill in the art will thus appreciate that the system and method of this disclosure provides a versatile arrangement for inhibiting damage to a blade or moldboard of a machine such as a motor grader 10. At least some embodiments of the system and method may be adapted to operate with a desired level of operator input or no operator input.

At least some embodiments of the system and method may provide decrease downtime for repairs to the blade, moldboard, or cutting edge. At least some embodiments of the system and method may reduce downtime for an operator performing blade review and measurement. Accordingly, at least some embodiments of the system and method may provide enhanced machine productivity, and may decrease road maintenance cost.

The described principles may be applicable to mobile machines that are used for grading applications that include a blade. A primary example of such a machine is a motor grader. Within such applications, the described principles may provide a sequence of actions that may be automatically occur in order to inhibit damage to the blade or moldboard.

While the method has been described with regard to exemplary moldboard protection auto sequences, those of skill in the art will appreciate that alternative ordering and combinations of steps may be utilized. Thus, although it will be appreciated that the foregoing description provides useful examples of the disclosed system and technique, it should be appreciated that other implementations of the disclosed principles will differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein.

We claim:

1. A mobile work machine, the mobile work machine having given machine parameters and comprising:
   a frame,
   a plurality of wheels supporting the frame, one or more of the plurality of wheels being driven,
   a blade extending from the frame toward a surface underlying the mobile work machine, the blade including a cutting edge, the cutting edge being disposed along a lower edge of the blade,
   one or more blade tilt cylinders configured to articulate the blade to a plurality of pitch angles,
   a blade pitch sensor configured to detect a current pitch of the blade,
   a camera, the camera configured to detect the cutting edge, and
   a control system to control damage to the blade, the control system including at least one controller configured to:
      receive image data,
      determine a current width of the cutting edge based on the image data, and
      determine a maximum allowable pitch angle of the blade based on one or more machine parameters of the machine and based on the current width of the cutting edge, wherein exceeding the maximum allowable pitch angle is associated with a damage condition of the blade.

2. The mobile work machine of claim 1 wherein the controller is further configured to receive one or more signals from the blade pitch sensor, determine a current pitch angle of the blade, and compare the maximum allowable pitch angle to the current pitch angle of the blade.

3. The mobile work machine of claim 2 wherein the controller is further configured to provide an operator alert to the user interface if the current pitch angle is substantially equal to or greater than the maximum allowable pitch angle.

4. The mobile work machine of claim 2 wherein the controller is configured to direct an operation to adjust the current pitch angle to a pitch angle that is not greater than the maximum allowable pitch angle if the current pitch angle is greater than the maximum allowable pitch angle.

5. The mobile work machine of claim 2 wherein the controller is configured to determine if the current pitch angle of the blade is equal to or greater than the maximum allowable pitch angle, and if the current pitch angle of the blade is equal to or greater than the maximum allowable pitch angle, the controller is further configured to at least one of inhibit movement of the blade to a pitch angle greater than the maximum allowable pitch angle, and perform an operation to adjust the current pitch angle to an adjusted pitch angle that is not greater than the maximum allowable pitch angle.

6. The mobile work machine of claim 5 wherein, if the current pitch angle of the blade is adjusted to the adjusted pitch angle, the controller is configured to
   determine a second current width of the cutting edge based upon image data associated the camera,
   determine a second maximum allowable pitch angle of the blade based upon the machine parameters and the second current width of the cutting edge, and
   compare the second maximum allowable pitch angle to a second current pitch angle of the blade.

7. The mobile work machine of claim 1 wherein the blade includes a moldboard and the cutting edge, the moldboard having a moldboard lower edge, the cutting edge extends beyond the moldboard lower edge.

8. The mobile work machine of claim 1 wherein the mobile work machine is a motor grader including a frame having a front frame and a rear frame, the front and rear frames being articulated relative to one another.

9. The mobile work machine according to claim 1 wherein the control system is configured to receive at least one signal from a user interface including a desired pitch angle.

10. A system for controlling damage to a blade of a motor grader, the blade including a cutting edge, the cutting edge being disposed along a lower edge of the blade, the motor grader further including one or more blade tilt cylinders configured to articulate the blade to a plurality of pitch angles, the system comprising:
   a blade pitch sensor configured to detect a current pitch of the blade,
   a camera that is configured to detect the cutting edge, and
   a control system including a controller configured to:
      receive image data associated with the camera,
      determine a current width of the cutting edge based on the image data, and
      determine a maximum allowable pitch angle of the blade based on one or more machine parameters of the motor grader and based on the current width of the cutting edge, wherein exceeding the maximum allowable pitch angle is associated with a damage condition of the blade.

11. The system of claim 10 wherein the controller is further configured to receive a signal from the blade pitch sensor, determine a current pitch angle of the blade, and compare the maximum allowable pitch angle to the current pitch angle of the blade.

12. The system of claim 11 wherein the controller is configured to determine if the current pitch angle of the blade is equal to or greater than the maximum allowable pitch angle, and if the current pitch angle of the blade is equal to or greater than the maximum allowable pitch angle, the controller is further configured to at least one of inhibit movement of the blade to a pitch angle greater than the maximum allowable pitch angle, and perform an operation to adjust the current pitch angle to an adjusted pitch angle that is not greater than the maximum allowable pitch angle.

13. The system of claim 11 wherein the controller is further configured to provide an operator alert to a user interface if the current pitch angle is substantially equal to or greater than the maximum allowable pitch angle.

14. The system of claim 11 wherein the controller is configured to perform an operation to adjust the current pitch angle to a pitch angle that is not greater than the maximum allowable pitch angle if the current pitch angle is greater than the maximum allowable pitch angle.

15. The system of claim 12 wherein, if the pitch angle of the blade is adjusted, the controller is configured to
   receive at least further image data from the camera based upon the camera further detecting the cutting edge by camera,
   determine a second current width of the cutting edge based upon further image data associated with the camera,
   determine a second maximum allowable pitch angle of the blade based upon the one or more machine parameters and the second current width of the cutting edge, determine a second current pitch angle of the blade, and
   compare the second maximum allowable pitch angle to the second current pitch angle of the blade.

16. A method of controlling damage to a blade of a motor grader, the blade including a cutting edge, the cutting edge being disposed along a lower edge of the blade, the motor grader further including one or more blade tilt cylinders configured to articulate the blade to a plurality of pitch angles, the method including:

determining a current width of the cutting edge based on image data associated with a camera of the motor grader that is configured to detect the cutting edge, determining a maximum allowable pitch angle of the blade based on one or more machine parameters of the motor grader and based on the current width of the cutting edge, wherein exceeding the maximum allowable pitch angle is associated with a damage condition of the blade, determining a current pitch angle of the blade, determining that the current pitch angle exceeds the maximum allowable pitch angle; and based on determining that the current pitch angle exceeds the maximum allowable pitch angle, at least one of causing an action to be performed or indicating that an action is to be performed, in relation to the current pitch angle, to avoid the damage condition.

17. The method of claim 16 further including providing an operator alert to a user interface if the current pitch angle is substantially equal to or greater than the maximum allowable pitch angle.

18. The method of claim 16 further including performing an operation to adjust the current pitch angle to a pitch angle that is not greater than the maximum allowable pitch angle if the current pitch angle is greater than the maximum allowable pitch angle.

19. The method of claim 16 further including, if the current pitch angle of the blade exceeds the maximum allowable pitch angle, at least one of inhibiting movement of the blade to an adjusted pitch angle greater than the maximum allowable pitch angle, and adjusting the current pitch angle to an adjusted pitch angle that is not greater than the maximum allowable pitch angle.

20. The method of claim 19 wherein, if the pitch angle of the blade is adjusted to an adjusted pitch angle, the method further includes determining a second current width of the cutting edge based upon second image data associated with the camera, determining a second maximum allowable pitch angle of the blade based upon the machine parameters and the second current width of the cutting edge, determining a second current pitch angle of the blade, and comparing the second maximum allowable pitch angle to the second current pitch angle of the blade.

* * * * *